US011203847B1

(12) United States Patent
Gordon

(10) Patent No.: US 11,203,847 B1
(45) Date of Patent: Dec. 21, 2021

(54) APPARATUS FOR COLLECTING WASTE MATERIAL

(71) Applicant: Bruce F. Gordon, Milton (CA)

(72) Inventor: Bruce F. Gordon, Milton (CA)

( * ) Notice: Subject to any disclaimer, the term of this patent is extended or adjusted under 35 U.S.C. 154(b) by 184 days.

(21) Appl. No.: 16/571,672

(22) Filed: Sep. 16, 2019

(51) Int. Cl.
*E01H 1/12* (2006.01)

(52) U.S. Cl.
CPC ..... *E01H 1/1206* (2013.01)

(58) Field of Classification Search
CPC ..... E01H 1/1206
See application file for complete search history.

(56) References Cited

U.S. PATENT DOCUMENTS 5,513,942 A * 5/1996 Pickrell ..... B65F 3/00 414/525.2
6,305,034 B1 * 10/2001 Perez Urrutia ..... A47K 17/00 4/144.2
6,305,322 B1 * 10/2001 Patel ..... E01H 1/1206 119/161
7,448,659 B1 * 11/2008 Auseklis ..... E01H 1/1206 294/1.4
10,352,008 B2 * 7/2019 Tiger ..... E01H 1/1206
10,392,760 B1 * 8/2019 Luk ..... E01H 1/1206
2004/0145196 A1 7/2004 Katz

* cited by examiner

*Primary Examiner* — Stephen A Vu
(74) *Attorney, Agent, or Firm* — Sanchelima & Associates, P.A.; Christian Sanchelima; Jesus Sanchelima

(57) ABSTRACT

An apparatus for collecting waste material is disclosed. The apparatus comprises a housing, a handle and telescopic arms mounted to the housing. The apparatus comprises a first roller and a second roller. The first roller is mounted to one telescopic arm and the second roller is mounted to the other telescopic arm. The apparatus comprises a sheet dispenser holding a sheet. There is a motor mounted to the sheet dispenser. Squeezing of the handle opens the telescopic arms. The motor is operated in a forward direction to dispense the sheet over the telescopic arms and the rollers. The telescopic arms in open position are aligned with a waste material, and the motor is operated in a reverse direction to rotate the rollers inwards in order to pull the waste material into the sheet. The handle is released to dispose off the sheet comprising the waste material.

11 Claims, 8 Drawing Sheets

APPARATUS FOR COLLECTING WASTE MATERIAL

BACKGROUND OF THE INVENTION

1. Field of the Invention

The present disclosure relates to apparatuses for collecting waste materials. More specifically, the present disclosure relates an apparatus for collecting waste material such as pet's feces without coming in contact with hands of a user.

2. Description of the Related Art

It is known many people keep pets or companion animals at home. Most popular pets include dogs and cats among other animals. People may keep the pets for a variety of reasons such as for person's company, protection, or entertainment. As known, pets may or may not have a routine to release animal waste. Further, if the pet is not trained, then the pet may release the animal waste inside of the house. As known, it is important to keep the house as well as public places clean at all times for variety of reasons such as hygiene, cleanliness, and so on.

In order to clean the animal waste, owners of the pet may carry "pooper-scoopers", a newspaper, tissue or plastic litterbags. At the time of picking up and/or transporting and delivering the animal waste of the pet, the owners may accidently come in contact with the animal waste with his or her hands. As a result, it is a very odious and unpleasant task for the owners. Further, there is a risk of leakage when using newspaper, tissues and plastic litterbags to pick and dispose of the animal waste. The same applies for waste materials of any sort not just pet waste. As such the present invention may be used for collection of waste of any kind.

In order to overcome the problems of using the "pooper-scoopers", newspapers, tissues or plastic litterbags, several devices have been provided in the past that can used to collect material waste such as animal waste. An example of a device for collecting animal waste is disclosed in United States patent application 20040145196. In US20040145196A1, it is disclosed that a substance retrieving device comprising a receiving member, a liner, a rod member, and a handle grip member is provided. The receiving member has an open and position and is translated between those two positions when the handle grip is squeezed. The liner is disposed on the inner receiving surface of the receiving and extends external to the receiving member. Additionally, a plurality of liners are disposed on top of one another. The rod member is attached to the receiving at the rod member first end and to the handle grip member at the rod member end.

Although the devices discussed above are helpful in collecting the animal waste, they have few problems. For instance, the devices require lot of efforts from the user such as positioning the sheet to collect the animal waste. Further, the user has to manually remove the bag or sheet after collecting the animal waste. Therefore, there is a chance that the user may come in contact with the animal waste while the bag is being carried for disposal. Additionally, when shovel type configurations of the devices are used, they do not sufficiently prevent the user's hand or arm from contacting the animal waste. The close proximity of the handle to the shovel end places the user's hand closer to the action, i.e., the point at which shovel end contacts the animal waste. As a result, an accidental slippage of the hand from the handle will immerse the hand in the animal waste.

Other documents describing the closest subject matter provide for a number of more or less complicated features that fail to solve the problem in an efficient and economical way. None of these patents suggest the novel features of the present invention. Specifically, none of the disclosures in the art disclose an apparatus for collecting waste material such as pet's feces without coming in contact with the hands of a user. Specifically, none of the disclosures in the art disclose an apparatus comprising telescopic arms and rollers used in conjunction with sheets or bags for collecting animal waste and disposing off the sheet without coming in contact with the hands of the user.

Therefore, there is a need to provide an apparatus for collecting waste material such as pet's feces without coming in contact with hands of a user.

SUMMARY OF THE INVENTION

It is one of the objects of the present invention to provide an apparatus for collecting waste material such as pet's feces without coming in contact with the hands of a user and that avoids the drawbacks of the prior art.

It is another object of the present invention to provide an apparatus comprising telescopic arms and rollers used in conjunction with sheets or bags for collecting of waste and disposing of the sheet without coming in contact with the hands of the user.

It is still another object of the present invention to be inexpensive and durable.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus for collecting waste material. The apparatus comprises a housing, a handle mounted to the housing, and telescopic arms mounted to the housing. The telescopic arms comprise a first telescopic arm and a second telescopic arm. The apparatus comprises rollers mounted to the telescopic arms. The rollers comprise a first roller and a second roller. The first roller is mounted to the first telescopic arm and the second roller is mounted to the second telescopic arm. The apparatus comprises a sheet dispenser provided in the housing. The sheet dispenser comprises a sheet. The apparatus comprises a motor mounted to the sheet dispenser via a pulley. The handle and the telescopic arms form a scissor-like structure in that the squeezing the handle opens the telescopic arms. The motor is operated in a forward direction to dispense the sheet over the telescopic arms and the rollers. The telescopic arms in open position are aligned with a waste material, and the motor is operated in a reverse direction to rotate the rollers inwards in order to pull the waste material into the sheet. The handle is released to dispose off the sheet comprising the waste material.

Various features and embodiments of an apparatus for collecting waste material are explained in conjunction with the description of FIGS. 1-8.

Figure 1:
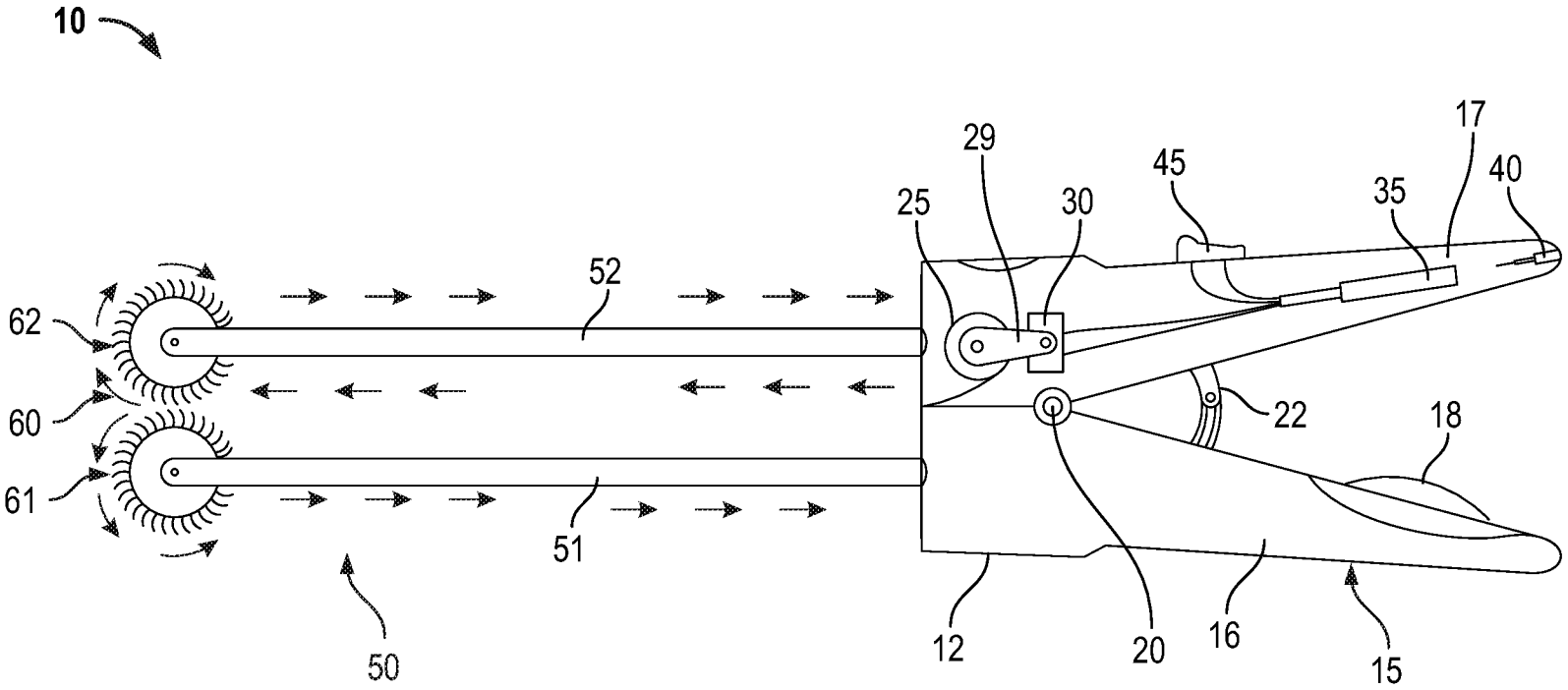
FIG. 1 illustrates a schematic diagram of an apparatus 10 for collecting waste material or objects, in accordance with one embodiment of the present disclosure.
Figure 2:
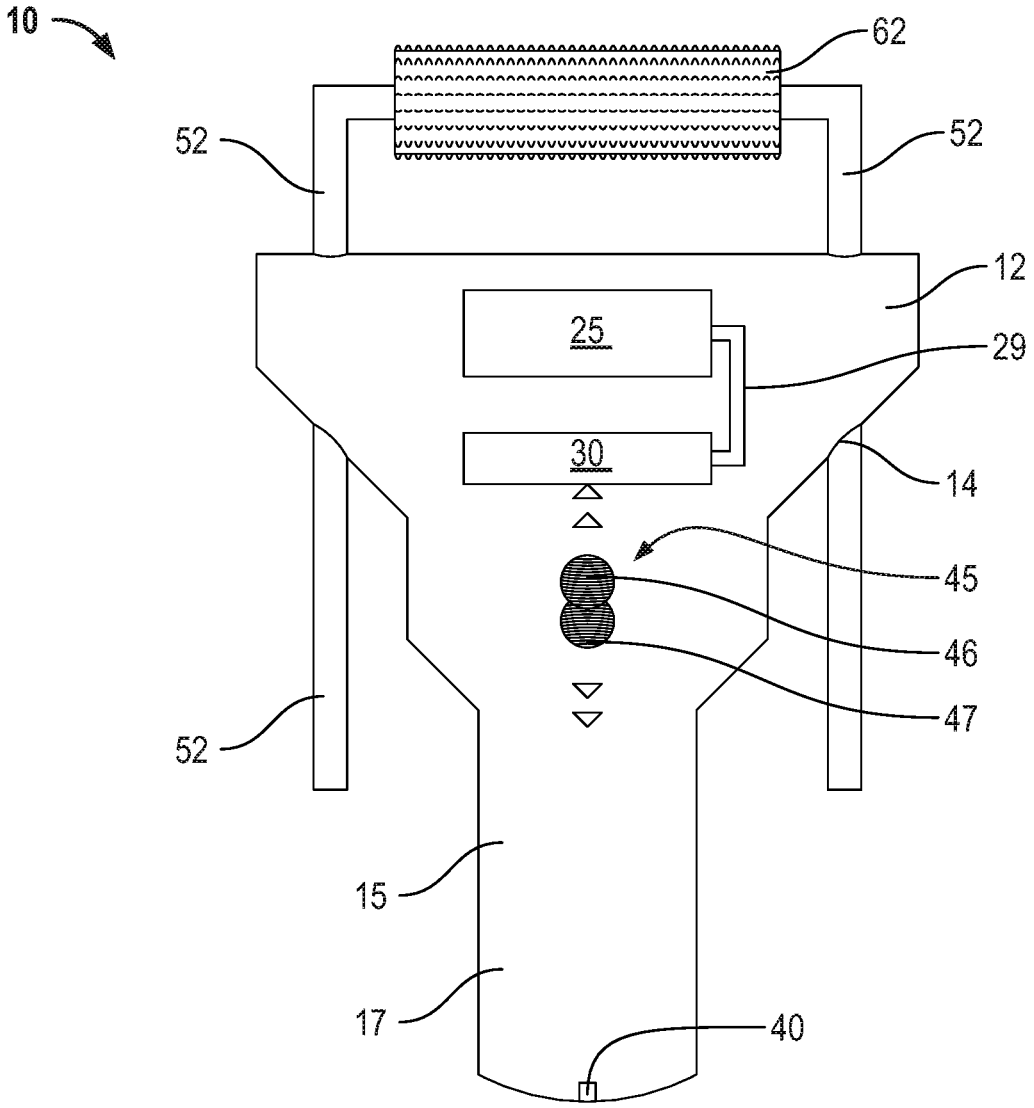
FIG. 2 illustrates a top view of the apparatus 10, in accordance with one embodiment of the present disclosure.
Figure 3:
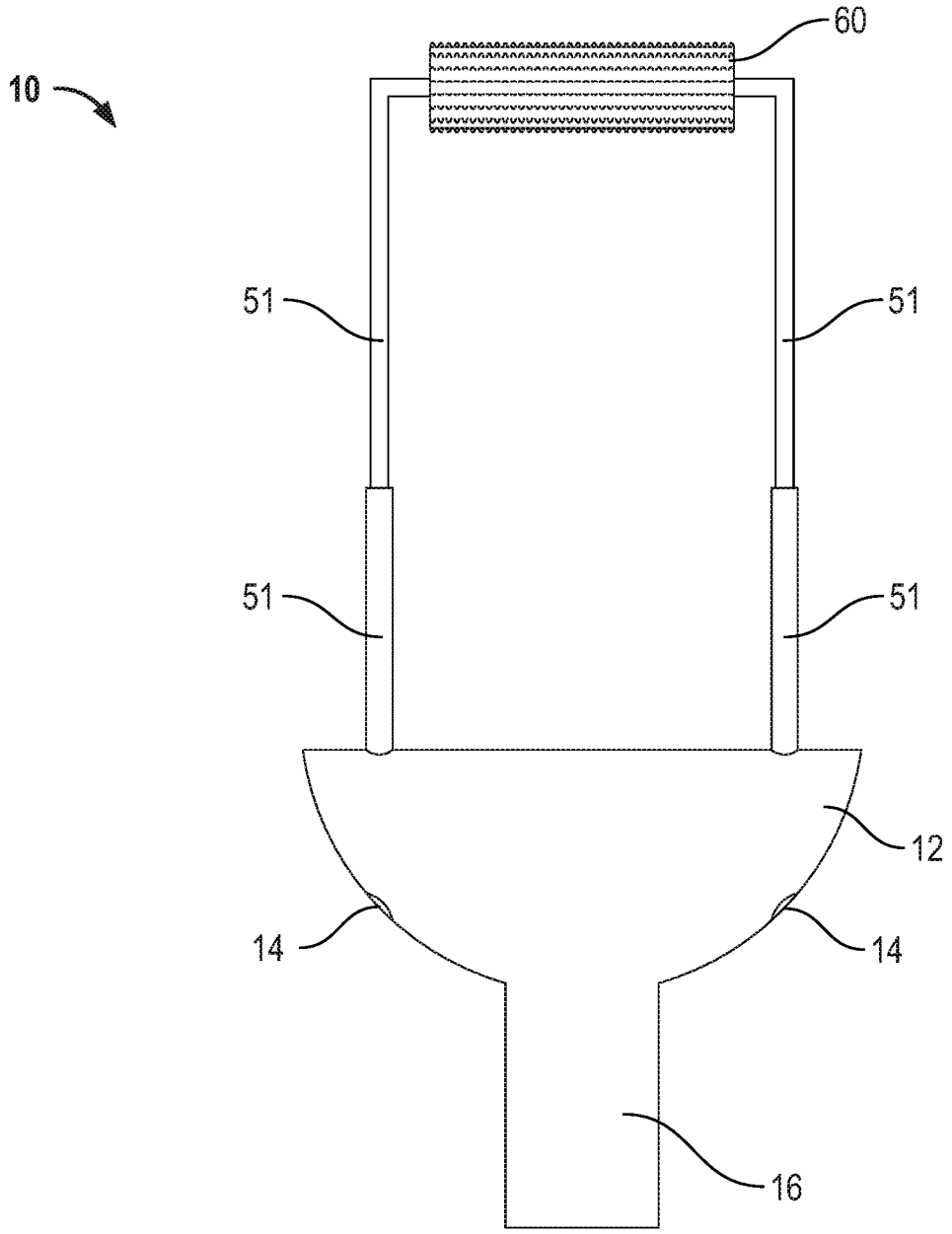
FIG. 3 illustrates a bottom view of the apparatus 10, in accordance with one embodiment of the present disclosure.

Referring to FIG. 1, a schematic diagram of an apparatus 10 for collecting waste material or objects is shown, in accordance with one embodiment of the present disclosure. The apparatus 10 comprises a housing 12. The housing 12 might be made up of metal, wood, plastic or any other material. The housing 12 might be provided in a square, rectangular, oval, semi-circular, conical or any other shape. Referring to FIGS. 2 and 3, a top and a bottom view, respectively of the apparatus 10 are shown. As can be seen, the housing 12 may be provided in a conical shape. Further, the housing 12 comprises openings 14 provided through the housing 12.

Now referring to FIGS. 1, 2 and 3, the apparatus 10 comprises a handle 15 mounted to the housing 12. The handle 15 might be made up of metal, wood, plastic or any other material. The handle 15 may comprise a first handle 16 and a second handle 17. At one end, the first handle 16 might be provided with a handle grip 18 made up of soft material such as rubber or any other similar material. The handle grip 18 helps to hold the handle 15 firmly by a user. The first handle 16 is mounted to the second handle 17 with the help of a fastener 20. The fastener 20 may include a screw or tension screw, which utilizes known mechanism to allow the first handle 16 and the second handle 17 to move with respect to one another. Further, the handle 15 may comprise a connector 22 provided to couple the first handle 16 and the second handle 17.

Further, the apparatus 10 may comprise a sheet or roll dispenser 25 provided in the housing 12. Alternatively, the sheet dispenser 25 might be provided outside of the housing 12, for example the sheet dispenser 25 might be provided on top of the housing 12. In another implementation, the sheet dispenser 25 might be provided at the second handle 17. The sheet dispenser 25 may comprise a sheet or bag 27 rolled and mounted to the sheet dispenser 25. The sheet 27 may indicate a disposable bag made up of a plastic or wax paper bag.

The apparatus 10 further comprises a motor 30 provided in the housing 12. In another implementation, the motor 30 might be provided at the second handle 17. The motor 30 is mounted to the sheet dispenser 25 with the help of a pulley 29. The pulley 29 may indicate a belt like structure used to couple the motor 30 and the sheet dispenser 25. The pulley 29 is used to exert pressure on the sheet dispenser 25 in order to engage the sheet dispenser 25 to rotate in a direction of the motor 30. The apparatus 10 further comprises a battery 35 electrically mounted to the motor 30. The battery 35 may include a rechargeable battery such as a Lithium-Ion battery.

In one example, the apparatus 10 might be provided with a charging port 40 for charging the battery 35 or to power the motor 30 directly from a power source. As can be seen from FIG. 1, the sheet dispenser 25, the pulley 29, the motor 30, the battery 35 and the charging port 40 are provided at the second handle 17, however, it should be obvious to a person skilled in the art that sheet dispenser 25, the pulley 29, the motor 30, the battery 35 and the charging port 40 may also be provided in the first handle 16 or in the housing 12. Alternatively, the sheet dispenser 25, the pulley 29, the motor 30, the battery 35 and the charging port 40 might be distributed among the first handle 16, the second handle 17 and the housing 12.

Referring to FIGS. 1 and 2, the apparatus 10 further comprises a controller 45. The controller 45 indicates a button, switch or any other similar mechanism. The controller 45 comprises a forward controller 46 and a reverse controller 47. It should be understood that the forward controller 46 is used to operate the motor 30 in forward direction. Further, the reverse controller 47 is used to operate the motor 30 in reverse direction.

The apparatus 10 further comprises telescopic arms 50. The telescopic arms 50 might be made up metal, plastic or any other material. The telescopic arms 50 comprise a first telescopic arm 51 and a second telescopic arm 52 coupled to the housing 12. Specifically, the first telescopic arm 51 and the second telescopic arm 52 are drawn through the openings 14 provided at the housing 12. As can be understood from FIGS. 2 and 3, the telescopic arms 50 are extendable to adjust the length of the telescopic arms 50. In other words, the telescopic arms 50 can be extended to increase length of the telescopic arms 50 and can be contracted to reduce the length of the telescopic arms 50. As can be seen from FIG. 1, the first handle 16, the second handle 17 and the first telescopic arm 51 and the second telescopic arm 52 form a shape of scissor-like structure, in that the first handle 16 and the second handle 17 are squeezed to open the first telescopic arm 51 and the second telescopic arm 52, and the first handle 16 and the second handle 17 are released to close the first telescopic arm 51 and the second telescopic arm 52.

Further, the apparatus 10 comprises rollers 60. The rollers 60 might be made up of metal, plastic, rubber or any other material. In one example, the rollers 60 may include studded rollers. The rollers 60 comprise a first roller 61 and a second roller 62. The first roller 61 is mounted at one end of the first telescopic arm 51 and the second roller 62 is mounted at an end of the second telescopic arm 52, as can be seen in FIG. 1. It should be understood that the motor 60 is electrically coupled to the first roller 61 and the second roller 62.

Now referring to FIGS. 4 to 7, operation of the apparatus 10 is explained, in accordance with one embodiment of the present disclosure. The apparatus 10 can be used to collect waste material or objects. The waste material may include, but mot limited to, animal waste or pet feces from pets such as dogs, cats or other animals. Further, the waste material may also include decomposed objects, food or foul waste.

Figure 4:
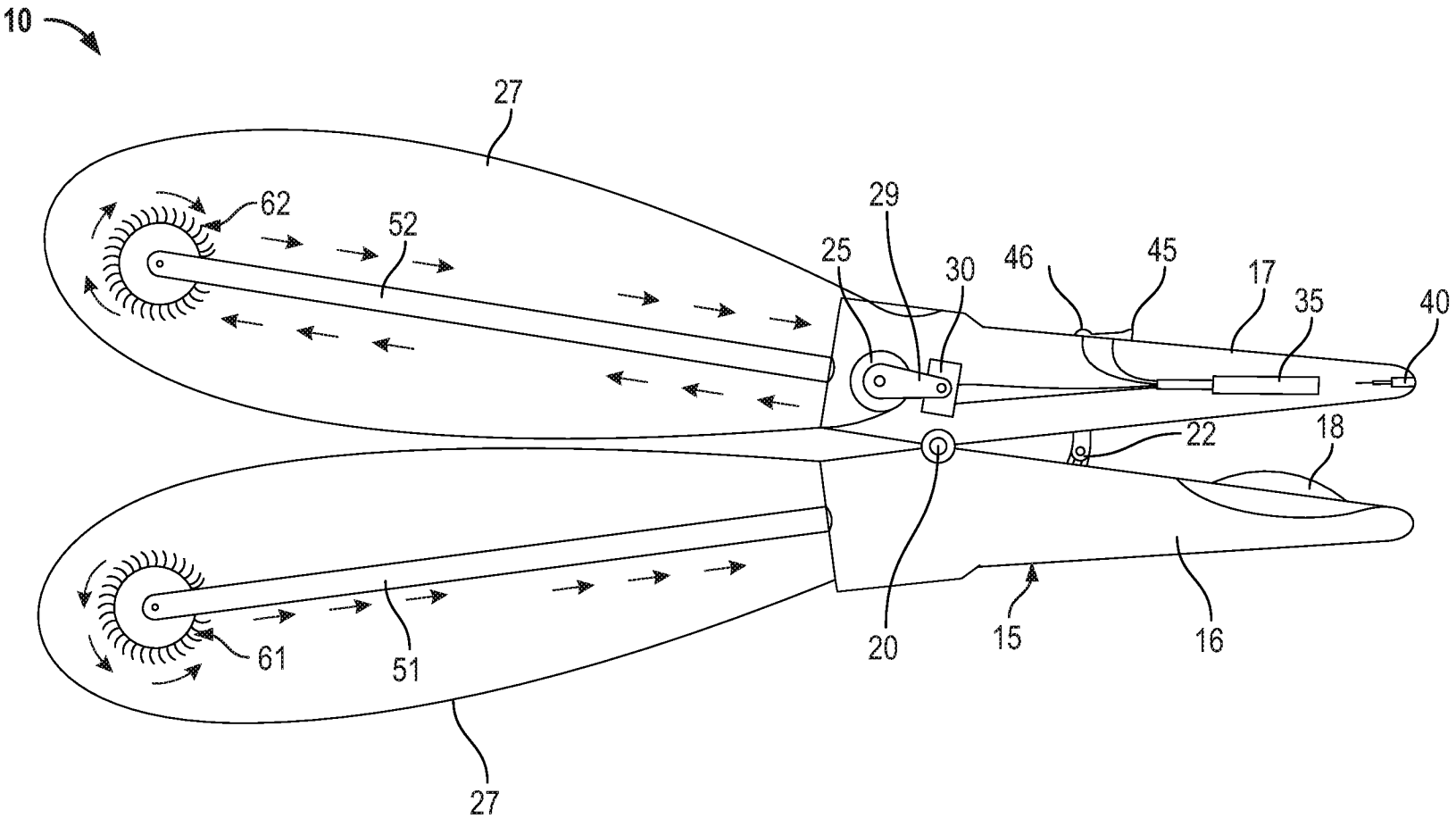
FIG. 4 illustrates squeezing of a handle 15 to open telescopic arms 50, in accordance with another embodiment of the present disclosure.

As specified above, the sheet 27 is rolled or wounded in the sheet dispenser 25. In order to collect waste material, at first, a user of the apparatus 10 may hold the handle 15 i.e., the first handle 16 and the second handle 17 with one or both hands. In order to operate the apparatus 10, the user may squeeze the first handle 16 and the second handle 17 so that the first telescopic arm 51 and the second telescopic arm 52 are made to separate, as shown in FIG. 4. In other words, the user squeezes the first handle 16 and the second handle 17 in order to open the first telescopic arm 51 and the second telescopic arm 52. Upon squeezing the first handle 16 and the second handle 17; the user may press the forward controller 46 of the controller 45 in order to engage the sheet dispenser 25. Specifically, when the user presses the forward controller 46, the motor 30 is engaged in a forward direction such that the sheet dispenser 25 is made to rotate and dispense the sheet 27 in the forward direction. Additionally, the rollers 60 are made to rotate to pull out the sheet 27 over the rollers 60 and the telescopic arms 50. The forward controller 46 is pressed until the sheet 27 is made to come over the first telescopic arm 51 and the first roller 61, and the second telescopic arm 52 and the second roller 62, as shown in FIG. 4. It should be understood that the forward controller 46 is pressed until sufficient length of the sheet 27 is dispensed which covers the length of the telescopic arms 50 around the rollers 60.

Figure 5:
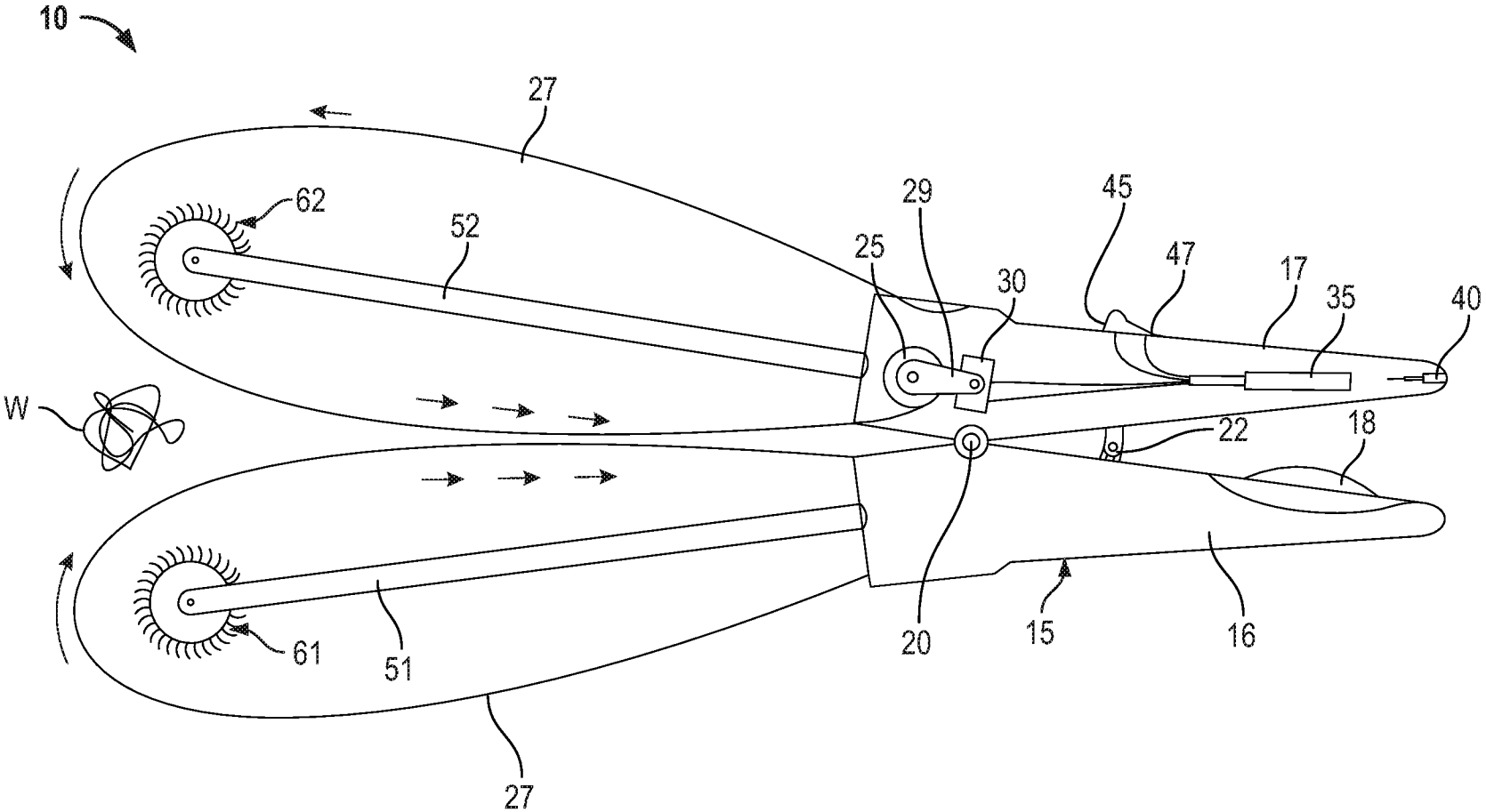
FIG. 5 illustrates the apparatus 10 positioned to collect a waste material W, in accordance with one embodiment of the present disclosure.

Upon dispensing the desired amount of the sheet or bag 27 over the telescopic arms 50 and the rollers 60, the apparatus 10 is positioned facing waste material W. Specifically, the side where the rollers 60 are provided is made to face the waste material W, as shown in FIG. 5. After positioning the telescopic arms 50 in open position with respect to the waste material W, the user may press the reverse controller 47. When the reverse controller 47 is pressed, the motor 30 is made to operate in the reverse direction such that the pulley 29 is made to pull the sheet dispenser 25 in the reverse direction. Additionally, the rollers 60 are made to rotate inwards such that the rollers 60 pull the waste material W into the sheet 17 as shown in FIG. 5. It should be understood that the waste material W is pulled into the sheet 27 due to the pull force exerted by the rollers 60 with the help of the motor 30.

Figure 6:
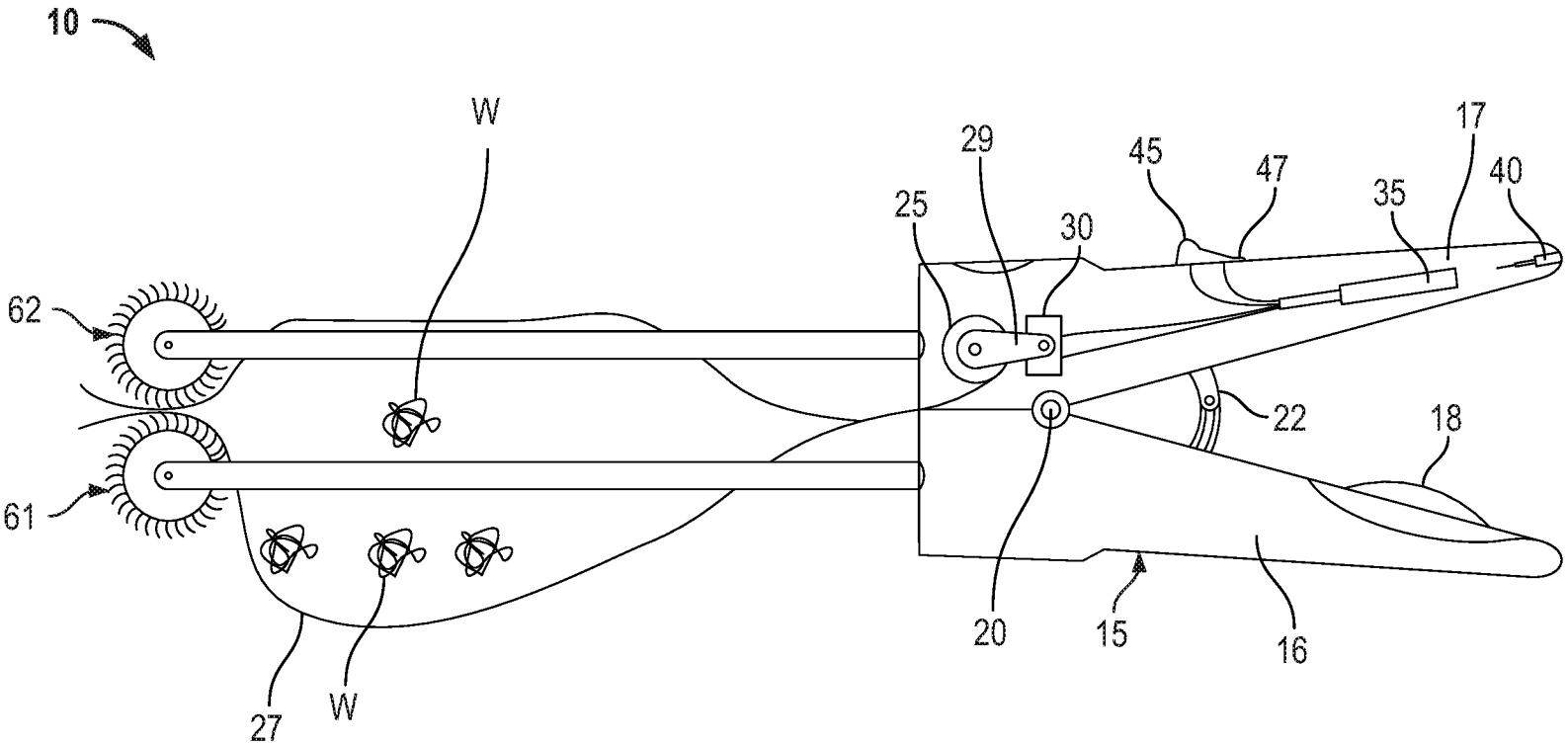
FIG. 6 illustrates operation of a motor 30 of the apparatus 10 in reverse direction to collect the waste material W into a sheet 27 in accordance with one embodiment of the present disclosure.

Now referring to FIG. 6, the sheet 27 being pulled over the telescopic arms 50 is shown. In should be understood that the FIG. 6 shows the waste material W collected in the sheet 27 and being pulled along with the sheet 27.

Figure 7:
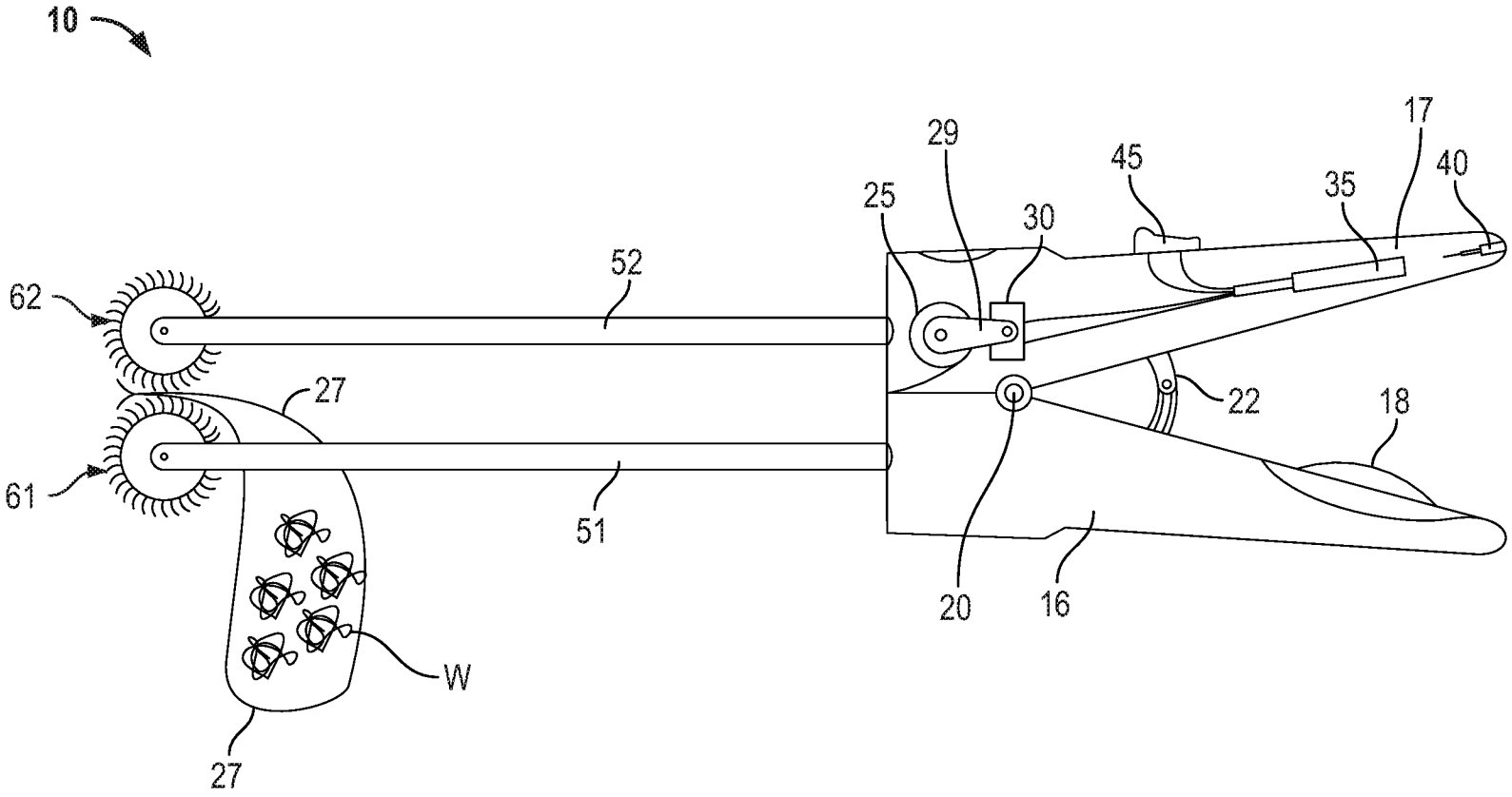
FIG. 7 illustrates disposing of the sheet 27 in accordance with one embodiment of the present disclosure.

After pulling the sheet 27 holding the waste material W, the user may carry the apparatus 10 to dispose off the sheet 27. For example, the user may carry the apparatus 10 to a waste collector or bin placed outside of a building. In order to dispose of the sheet 27 holding the waste material W, the user may release the handle 15 such that the first handle 16 and the second handle 17 are made to separate, as shown in FIG. 7. In other words, the user releases the first handle 16 and the second handle 17 in order to disengage or release the sheet 27 from the rollers 60. As a result, the sheet 27 holding the waste material W is released from the apparatus 10 and the sheet 27 is made to fall into the waste collector. The user may repeat the above process to collect waste material W from another location.

Although the present disclosure is explained considering that the sheet is dispensed from the sheet dispenser, it should be understood that the user might manually place the sheet or disposable bag over the telescopic arms and the rollers. After placing the sheet, the user may press the controller i.e., the reverse controller in order to operate the motor in the reverse direction to operate the rollers to pull the sheet inwards. As the rollers are being rolled inwards, the waste material is pulled into the sheet or disposable bag. Subsequently, the user may carry the apparatus to a nearest waste collector such as waste bin and release the handle to drop or dispose off the sheet with the waste material into a waste collector.

As length of the extendable arms can be extended to a desired length, the user hand holding the handle will not come in close proximity to the waste material. Further, if there is an accidental slippage of hand from the handle, then that will not result in hand coming in contact with the waste material. Therefore, the user can be sure of not coming in contact with the waste material at the time of collecting the waste material. Further, the sheet that comes in contact with the waste material is disposed of; as a result, the extendable arms and the rollers also do not come in contact with the waste material. Therefore, the apparatus can be kept clean at all times.

It should be understood that the apparatus might be operated by directly coupling to a power source with the help of a cable. Alternatively, the apparatus might be used as a standalone device, in which the apparatus is powered with the help of the battery as explained above.

Figure 8:
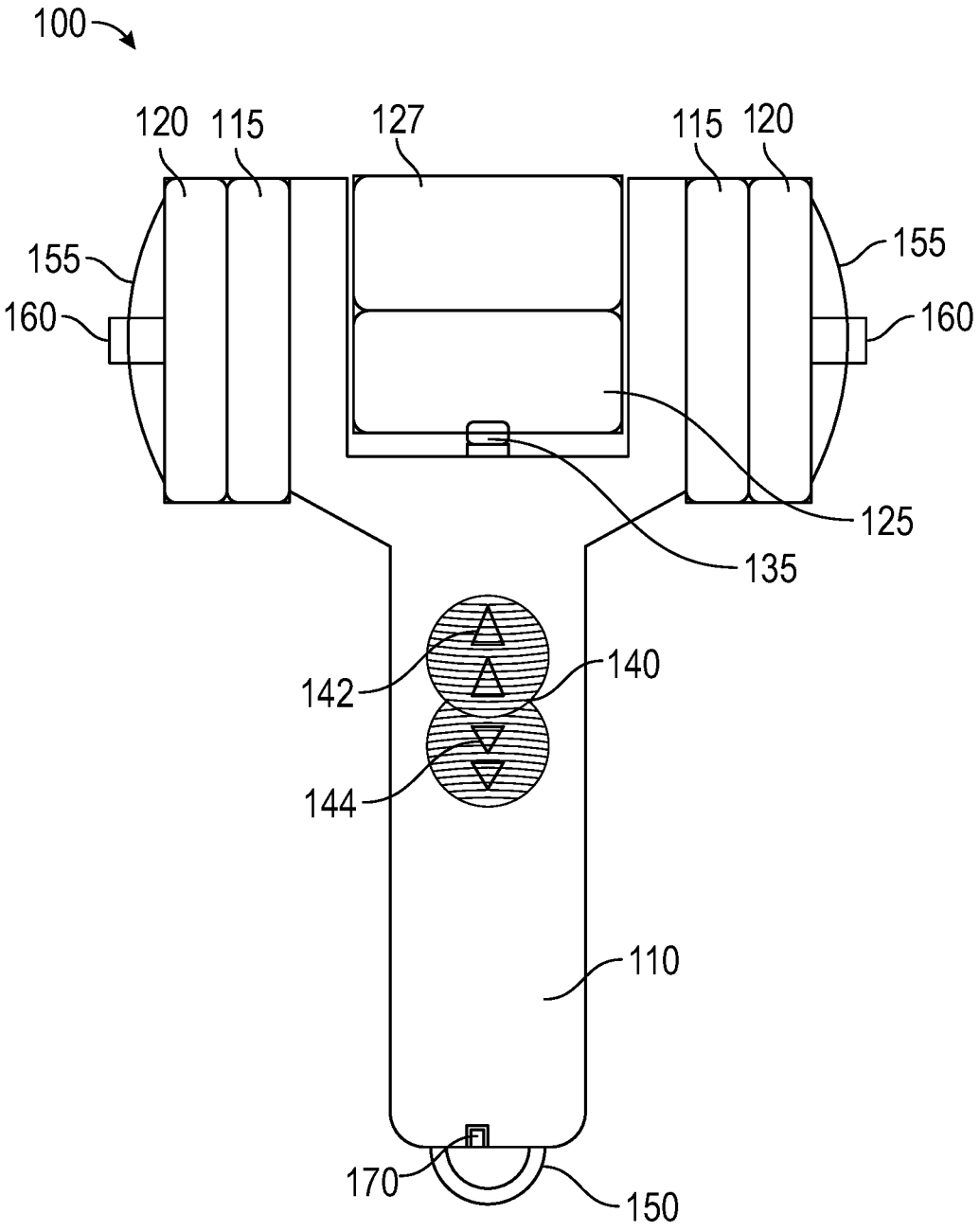
FIG. 8 illustrates an alternative embodiment of the apparatus 10.

Now referring to FIG. 8, an alternate embodiment of apparatus 100 of the present invention can be seen. In this embodiment there are rotating wheels to receive and control arms such as telescopic arms 50. The wheels can be further defined as inner wheels 115 and outer wheels 120. Inner wheels 115 can be used to for controlling and holding of a lower arm such as first telescopic arm 51, for example. While outer wheels 120 may be used for controlling and holding of an upper arm such as second telescopic arm 52, for example. Or vice versa in an alternate embodiment. Further, it can be seen that apparatus 100 may include knobs 155. There may be one of knobs 155 on each left and right side of the present invention. Knobs 155 may preferably work together to hold and secure arms in place. Knobs 155 may be used to locks arms such as telescopic arms 50. Knobs 155 are turned or rotated in order to achieve the locking of the arms such as telescopic arms 50. Preferably knobs 155 are turned forward in order to lock telescopic arms 50 in place. Knobs 155 create a tightening around telescopic arms 50. While a reverse turn of knobs 155 may be done in order to detach a bag for use with the present invention. The bag may be dispensed by a sheet dispenser 127. Additionally, there may be at least one button 160 located on each left and right side of the present invention. At least one button 160 may be used to release the arms or to allow adjusting of the positions of telescopic arms 50. In the alternate embodiment there may also be a motor 125 adapted for use with sheet dispenser 127. Motor 125 helps to facilitate and automate the dispensing of sheets or bags with sheet dispenser 127. A handle 110 can also be seen in the alternate embodiment. Handle 110 may be used for gripping and maneuvering the present invention. Housed inside of handle 110 may be a power supply such as a battery, for example. The power supply may be used to power motor 125. Hence, there is a need for a plug socket 135. Plug socket 135 allows motor 125 to be powered by the power supply housed in handle 110. Apparatus 100 further comprises a controller 140. Controller 140 indicates a button, switch or any other similar mechanism. Controller 140 comprises a forward controller 142 and a reverse controller 144. It should be understood that the forward controller 142 is used to operate motor 125 in a forward direction. Further, the reverse controller 144 is used to operate motor 125 in a reverse direction. In can also be seen that in the alternate embodiment, apparatus 100 may include a ring 150 adapted for receiving and hooking onto a rope, string, lanyard or the like. With a lanyard, for example, mounted onto ring 150 a user may more easily carry and transport the present invention. In order to charge or supply power to the power supply of the present invention, apparatus 100 may include a charging port 170. A user simply plugs in the appropriate port such as a micro USB port or USB C port or any suitable charging port in order to recharge and power the housed power supply.

It should be understood that FIG. 8 is shown to illustrate another embodiment of the present disclosure. It should be understood that the apparatus might be provided in different shapes and sizes in which any one or all parts of the components can be provided in variety of shapes and sizes to dispense the sheet over the telescopic arms and the rollers, wherein the rollers are operated to pull the waste material into the sheet that can be disposed off in a waste bin. As such, it should be understood that the components depicted in figures are provided for illustrative purpose only and should not be construed in limited sense. A person skilled in the art will appreciate alternate parts and/or mechanisms might be used to implement the embodiments of the present disclosure and such implementations will be within the scope of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for an apparatus for collecting waste material, the apparatus comprising:

a) a housing;

b) a handle mounted to the housing;

c) telescopic arms mounted to the housing, wherein the telescopic arms comprise a first telescopic arm and a second telescopic arm;

d) rollers mounted to the telescopic arms, wherein the rollers comprise a first roller and a second roller, wherein the first roller is mounted to the first telescopic arm and the second roller is mounted to the second telescopic arm;

e) a sheet dispenser provided in the housing, wherein the sheet dispenser comprises a sheet;

f) a motor mounted to the sheet dispenser with the help of a pulley;

g) a battery provided in the handle, wherein the battery is electrically mounted to the motor; and h) a controller to operate the motor in a forward direction and a reverse direction, wherein the handle and the telescopic arms form a clamp structure in that the squeezing the handle opens the telescopic arms, wherein the controller is used to operate the motor in the forward direction to dispense the sheet over the telescopic arms and the rollers, wherein the telescopic arms in open position are aligned with a waste material and the motor is operated in the reverse direction to rotate the rollers inwards in order to pull the waste material into the sheet, and wherein the handle is released to dispose of the sheet comprising the waste material.

2. The system of claim 1, wherein the motor is mounted to the sheet dispenser using a pulley.

3. The system of claim 1, further comprises a battery provided in the handle, wherein the battery is electrically mounted to the motor.

4. The system of claim 1, wherein the first telescopic arm and the second telescopic arm are made to extend to increase the length and contracted to decrease the length.

5. The system of claim 1, further comprises a controller to operate the motor in the forward direction and the reverse direction.

6. The system of claim 1, wherein the sheet comprises a disposable bag made up of a plastic or wax paper bag.

7. The system of claim 1, further includes wheels, said wheels further defined as inner wheels and outer wheels are adapted to receive said telescopic arms in said apparatus, said inner wheels receive said first telescopic arm and said outer wheels receive said second telescopic arms.

8. The system of claim 1, further includes knobs, wherein said knobs are adapted to secure said telescopic arms in place, said knobs are turned to secure said telescopic arms.

9. The system of claim 1, further includes at least one button, wherein said telescopic arms are adjusted or released from said apparatus through a press of said at least one button.

10. The system of claim 1, further includes a plug socket, said motor is powered by said battery through said battery making contact with said plug socket.

11. The system of claim 1, wherein said apparatus further includes a ring adapted to receive a lanyard, rope, or string for easy carrying and transportation of the apparatus.

* * * * *